US008136202B2

(12) United States Patent
Hanley

(10) Patent No.: US 8,136,202 B2
(45) **Date of Patent: *Mar. 20, 2012**

(54) DOOR MOUNTING ASSEMBLIES

(75) Inventor: Marc Hanley, Brookvale (AU)

(73) Assignee: Marc Andrew Hanley, Brookvale (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/016,001

(22) Filed: Jan. 28, 2011

(65) Prior Publication Data

US 2011/0119870 A1 May 26, 2011

Related U.S. Application Data

(63) Continuation of application No. 11/564,079, filed on Nov. 28, 2006, now Pat. No. 7,900,318, and a continuation of application No. 29/247,024, filed on May 24, 2006, now Pat. No. Des. 558,569.

(60) Provisional application No. 60/740,106, filed on Nov. 28, 2005, provisional application No. 60/791,273, filed on Apr. 12, 2006.

(51) Int. Cl.
*A47H 13/00* (2006.01)

(52) U.S. Cl. ..... 16/87.6 R; 16/87.4 R; 16/94 R; 4/557; 4/607

(58) Field of Classification Search ..... 16/97.6 R, 16/87.4 R, 87.8, 93 R, 94 R, 95 R, 106; 4/557, 4/607; 160/196.1, 199
See application file for complete search history.

(56) References Cited

U.S. PATENT DOCUMENTS

| | | | |
|---|---|---|---|
| 1,380,668 | A | 6/1921 | Martin |
| 2,513,089 | A | 6/1950 | Ferris |
| 2,873,095 | A | 2/1959 | Blum |
| 3,457,677 | A | 7/1969 | Ziegler |
| 5,080,160 | A | 1/1992 | Gephart et al. |
| D324,645 | S | 3/1992 | Magro et al. |
| D335,353 | S | 5/1993 | Baker |

(Continued)

FOREIGN PATENT DOCUMENTS

DE 20 2006 002 337 U1 8/2006

(Continued)

OTHER PUBLICATIONS

International Search Report for International Application No. PCT/AU2006/001671, filed on Nov. 27, 2006.

*Primary Examiner* — Victor Batson
*Assistant Examiner* — Emily Morgan
(74) *Attorney, Agent, or Firm* — Tucker Ellis & West LLP

(57) ABSTRACT

A mounting assembly for operatively mounting one or more glass shower door panels to one or more panels is described. The mounting assembly includes an elongate guide assembly adapted for receiving and retaining a carriage assembly for mounting a reciprocating glass shower door; and a mounting assembly including one or more end mounting devices for mounting one or more ends of the elongate guide assembly perpendicular to one or more glass panels or walls. Also described is a mounting assembly including an elongate guide assembly adapted for receiving and retaining a carriage assembly for mounting a reciprocating glass shower door; and one or more spaced guide mounting devices for connecting the guide assembly to an adjacent parallel panel and spacing the guide assembly a selected distance from and parallel to the adjacent parallel glass wall panel to provide access between the parallel glass wall panel and guide assembly for cleaning.

19 Claims, 5 Drawing Sheets

U.S. PATENT DOCUMENTS

| | | | |
|---|---|---|---|
| D337,257 | S | 7/1993 | Danieli |
| D353,467 | S | 12/1994 | Raynes |
| 5,513,419 | A | 5/1996 | Zinger |
| 6,138,324 | A | 10/2000 | Lin |
| D443,357 | S | 6/2001 | Horsten |
| 6,381,904 | B1 | 5/2002 | Tedesucci |
| 6,446,394 | B1 | 9/2002 | Finke et al. |
| D489,209 | S | 5/2004 | Goldberg |
| D491,055 | S | 6/2004 | Chou |
| 2003/0068210 | A1 | 4/2003 | Pountney |
| 2003/0093875 | A1 | 5/2003 | Stefanidis |
| 2005/0235571 | A1 | 10/2005 | Ewing et al. |
| 2006/0062653 | A1 | 3/2006 | Erskine et al. |
| 2007/0186377 | A1 | 8/2007 | Pabst |

FOREIGN PATENT DOCUMENTS

| | | |
|---|---|---|
| EP | 0 753 637 B1 | 4/2000 |

DOOR MOUNTING ASSEMBLIES

CROSS REFERENCE TO RELATED APPLICATIONS

This application is a continuation application of U.S. patent application Ser. No. 11/564,079 filed Nov. 28, 2006 now U.S. Pat. No. 7,900,318 which claimed priority to U.S. Provisional Patent Application Ser. No. 60/740,106 filed Nov. 28, 2005 and U.S. Provisional Patent Application Ser. No. 60/791,273 filed Apr. 12, 2006, and which was a continuation application of U.S. Design Application Ser. No. 29/247,024 filed May 24, 2006, now D558,569, the entirety of which are incorporated by reference herein.

FIELD OF THE INVENTION

The subject application relates generally to mounting assemblies for sliding doors. One particular application for the subject application involves mounting frameless glass doors, associated with showers. Although it will be convenient to describe the subject application with reference to the abovementioned particular application, it is to be understood that this is not to be taken as a limitation of the scope of the subject application.

BACKGROUND OF THE INVENTION

It is known to provide sliding doors to control access to rooms of one type or another including shower recesses, however with current mounting assemblies and hardware it is difficult to maintain the mounting assemblies in a good working order and in good appearance, due to build up of grime, dirt, dust whilst still affording a degree of protection to the mounting assemblies.

The subject application seeks to ameliorate one or more of the abovementioned disadvantages.

SUMMARY OF THE INVENTION

According to one embodiment of the subject application there is provided a mounting means for operatively mounting one or more glass shower door panels to one or more glass or other wall panels, the mounting means including: an elongate guide assembly adapted for receiving and retaining a carriage assembly for mounting a reciprocating glass shower door; and a mounting assembly including one or more end mounting devices for mounting one or more ends of the elongate guide assembly perpendicular to one or more glass panels or walls.

In accordance with another aspect of the subject application there is provided a mounting means for operatively mounting one or more glass shower door panels to one or more glass or other wall panels, the mounting means including: an elongate guide assembly adapted for receiving and retaining a carriage assembly for mounting a reciprocating glass shower door; and one or more spaced guide mounting devices for connecting the guide assembly to an adjacent parallel glass wall panel and spacing the guide assembly a selected distance from and parallel to the adjacent parallel glass wall panel to provide access between the parallel glass wall panel and guide assembly for cleaning.

In accordance with yet another embodiment of the subject application there is provided a mounting means for operatively mounting one or more glass shower door panels to one or more glass or other wall panels, the mounting means including: an elongate guide assembly adapted for receiving and retaining a carriage assembly for mounting a reciprocating glass shower door; and a mounting assembly including one or more end mounting devices for mounting one or more ends of the elongate guide assembly perpendicular to one or more glass panels or walls, and one or more spaced guide mounting devices for connecting the guide assembly to an adjacent parallel glass wall panel and spacing the guide assembly a selected distance from and parallel to the adjacent parallel glass wall panel to provide access between the parallel glass wall panel and guide assembly for cleaning.

Preferably a carriage assembly is provided which includes a friction-reducing vehicle assembly for movement along a guide element associated with the guide assembly.

Preferably the guide assembly includes a housing for sealing and concealing the vehicle assembly which improves running performance, cleanliness and inhibits dirt and dust from collecting in the vehicle/guide element interface. In one embodiment the housing is at least partially cylindrical or an extruded part circle, to provide ease of cleaning to an outside cylindrical face and improved strength and protection for the vehicle assembly mounted therein.

In one embodiment, a cover plate is provided, mounted to the housing along one side, to provide a seal and protection for fastener heads.

The guide element may be in any suitable form, however preferably it includes spaced apart tracks having an intermediate gap therebetween. Lateral retaining means may be provided, in one form being a flange extending upwardly from the tracks to retain the vehicle in the lateral plane.

Preferably the cover plate is arcuate in section and of the same radius as the housing so as to provide a unified cylinder.

Preferably fastening elements are provided with the guide assembly, one fastening element being a threaded or fluted groove on an interior part of the housing, for receiving threaded fasteners at any position along a longitudinal axis of the housing. Apertures may be provided in order to access fastener heads for fastening along opposite walls of the housing.

A clamping block may be provided so as to clamp the guide assembly onto the glass panel or wall. Preferably the clamping blocks are in the form of a cylinder having a threaded recess for receiving a threaded fastener. Side clamps may be provided, as well as end clamps for connecting to, respectively, parallel walls and perpendicular walls. Preferably the side clamps are contoured on one face to receive the housing.

Preferably a stopper is provided to inhibit the vehicle extending past a selected part of the guide assembly.

Preferably the intermediate gap extends to an outside face of the housing so that a portion of the vehicle may extend therethrough for connecting to a door panel. The friction reducing elements on the vehicle assembly may be any suitable form, including skis, sleds, wheels, or any type of rolling bearing assembly. Preferably, there are provided two pairs of rollers for improving stability and for low friction. A connector may extend through the intermediate gap to connect to a clamp for suspending the door panel.

The clamp assembly preferably includes blocks and fasteners, the latter of which pass through an aperture of the glass panel, and is fastened to the blocks for spreading the clamping load to reduce stress on the door panel.

Preferably there are two carriages provided, spaced selected distances along an upper edge of a door panel.

The or each side mounting assembly may include a spacer assembly, which itself includes a spacer element, in one form contoured to support the housing, the contour being, in one form, a concave arc. A clamping block may be provided by having the spacer element on one side of the parallel wall panel and clamping block on the other with a fastener passing through each and tightened up with threaded interface.

An end support assembly may be provided, which includes an end support block, in one form having an offset tab which includes an aperture to retain the end support block in the lateral and longitudinal directions when connected to the housing. A longitudinal aperture may be provided in the end support block to allow a fastener to pass therethrough, when assembled, the fastener passing through an aperture in a perpendicular glass wall panel, and into the clamping block on an opposite side thereof.

It is contemplated that two parallel guide assemblies may be provided so that two frameless glass door panels may be independently moveable to control access to a shower recess. The two guide assemblies would be connected to an end wall at one end and a frameless glass wall panel at another end. Other mounting arrangements may be such that the two guide assemblies mounted parallel to one another between two spaced apart walls of a shower recess.

Still other advantages, embodiments and features of the subject application will become readily apparent to those skilled in the art from the following description wherein there is shown and described a preferred embodiment of the subject application, simply by way of illustration of one of the best modes best suited to carry out the subject application. As it will be realized, the subject application is capable of other different embodiments and its several details are capable of modifications in various obvious embodiments all without departing from the scope of the subject application. Accordingly, the drawings and descriptions will be regarded as illustrative in nature and not as restrictive.

BRIEF DESCRIPTION OF THE DRAWINGS

In order to enable a clearer understanding of the subject application, a preferred embodiment will hereinafter be described with reference to the attached drawings, and in those drawings.

DETAILED DESCRIPTION OF THE PREFERRED EMBODIMENT

Figure 1:
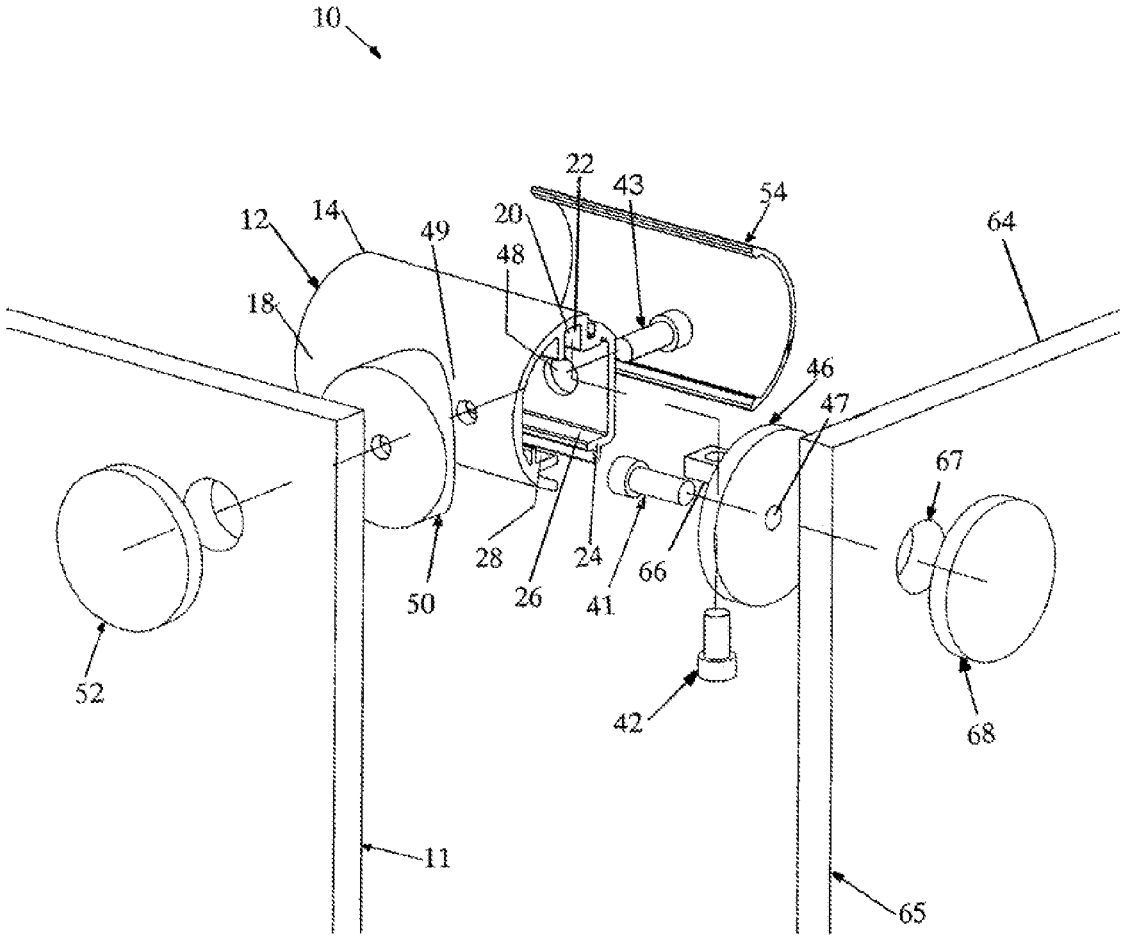
FIG. 1 is an exploded view of a mounting assembly according to a preferred embodiment of the subject application.
Figure 2:
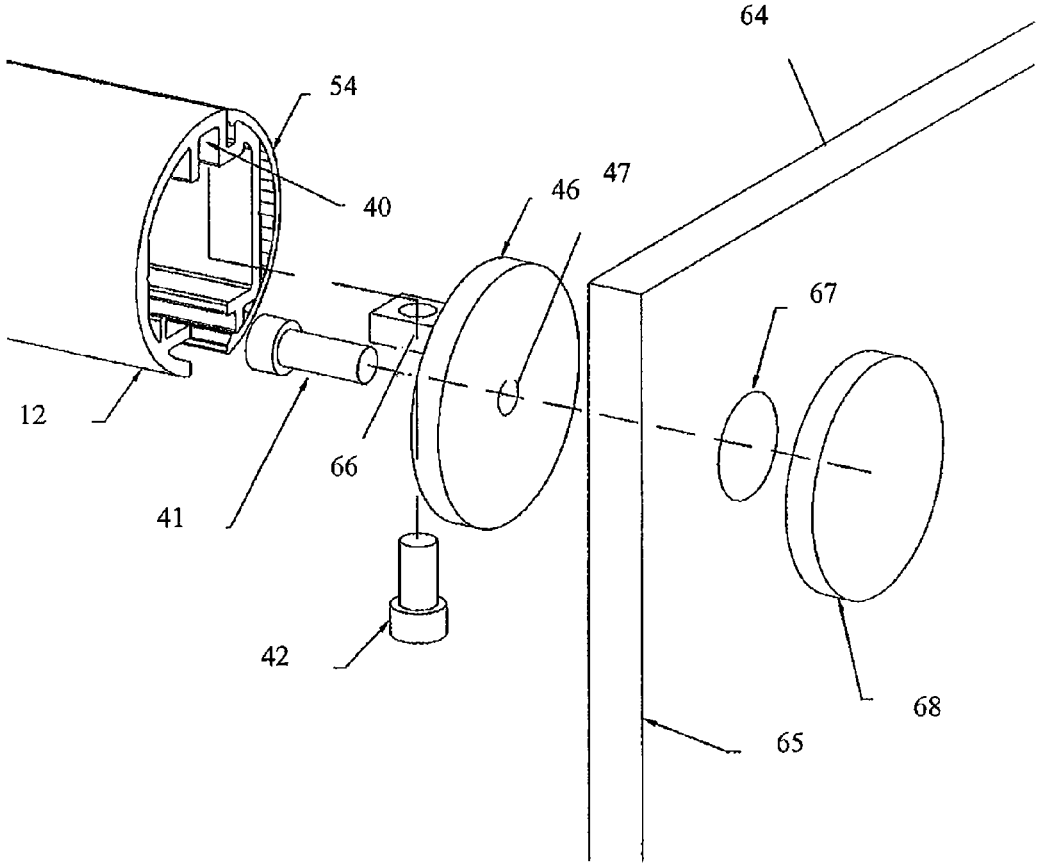
FIG. 2 is an exploded view of a mounting assembly according to a preferred embodiment of the subject application particularly showing an end mounting arrangement.
Figure 3:
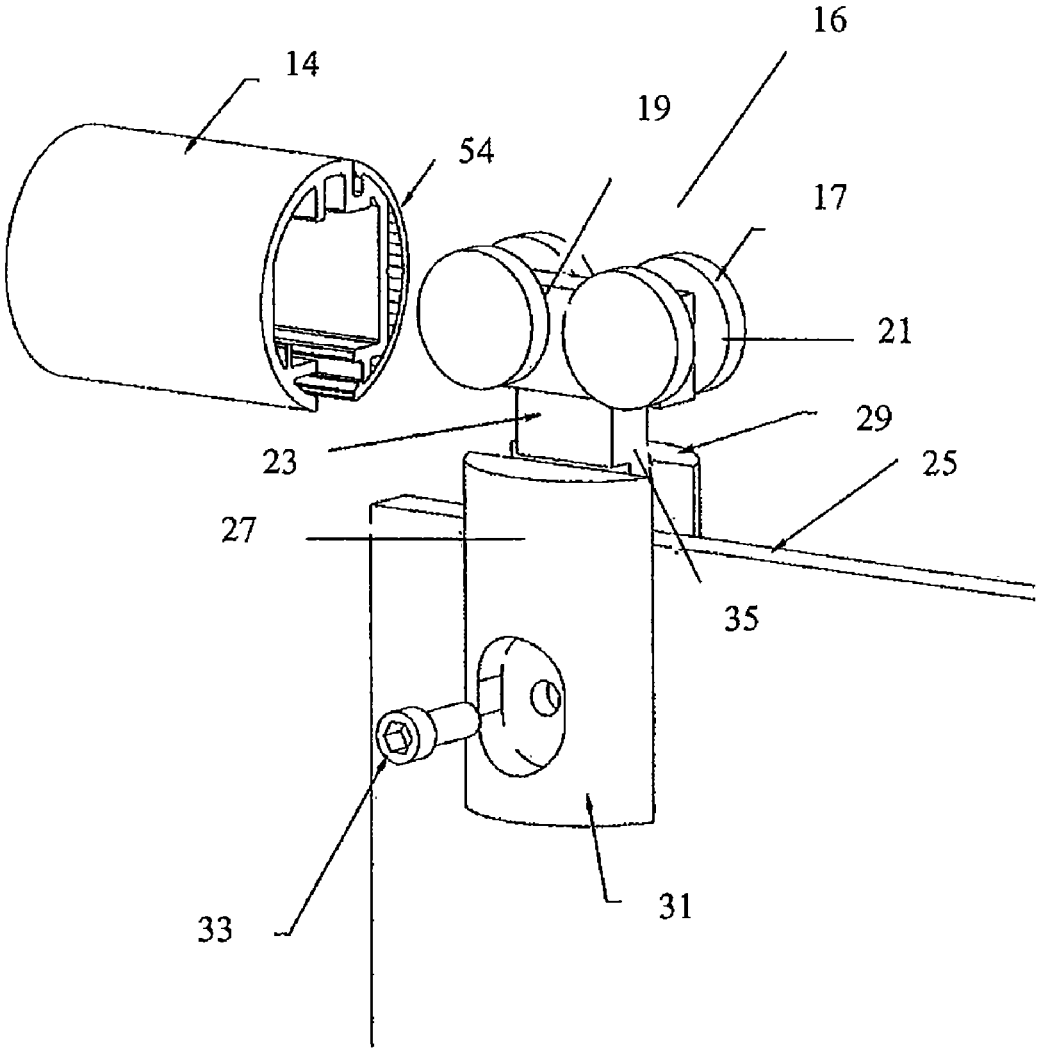
FIG. 3 is an exploded view of a vehicle assembly and guide assembly according to a preferred embodiment of the subject application.
Figure 4:
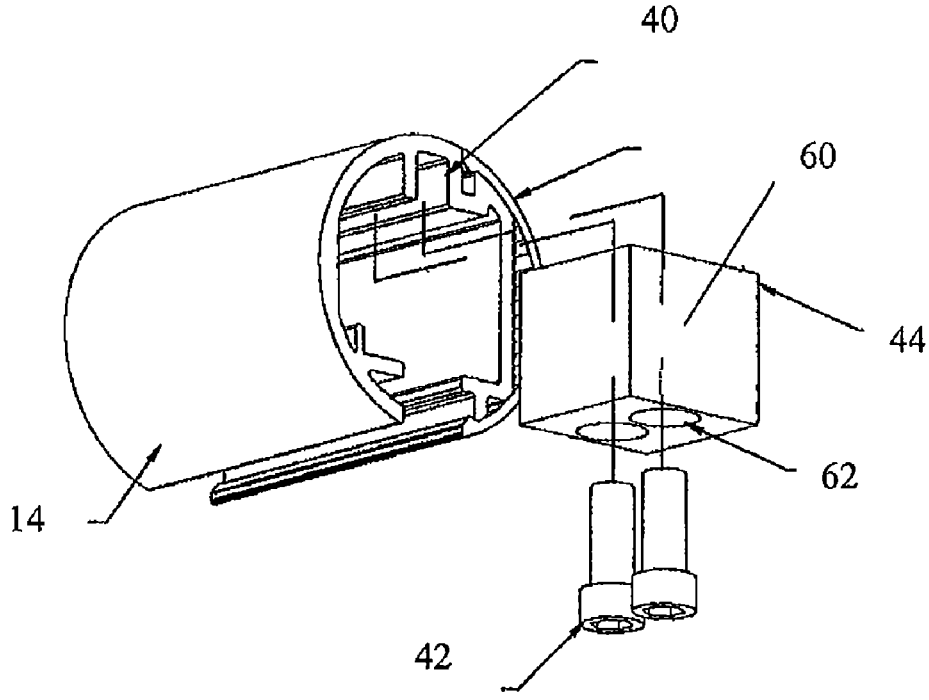
FIG. 4 is an exploded view of a guide assembly and stopper assembly.
Figure 5:
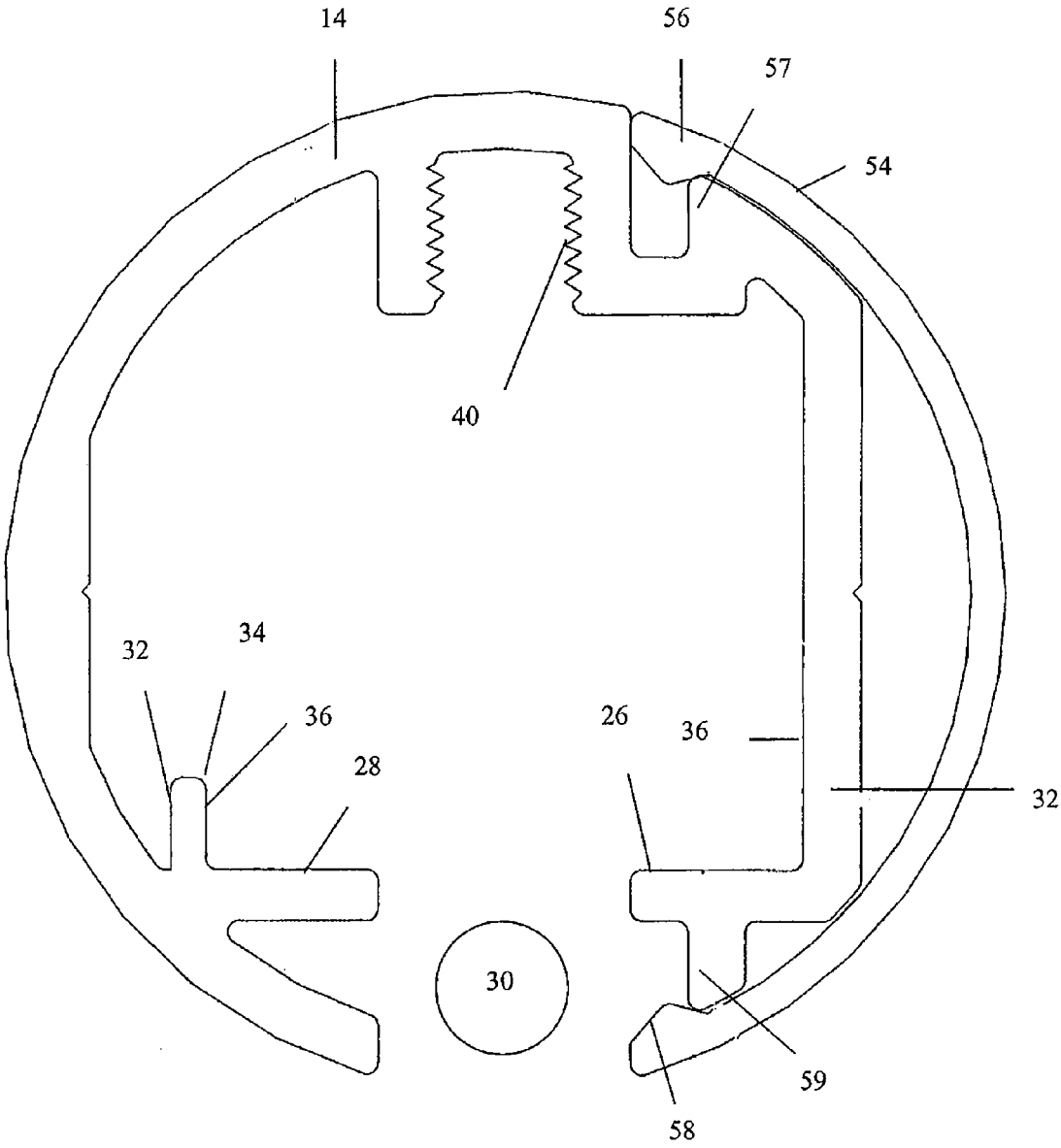
FIG. 5 is a section view of a housing according to a preferred component of the subject application.

Referring to the drawings there is shown a mounting assembly for operatively mounting a frameless glass shower door panel to an adjacent parallel glass wall panel, the mounting assembly generally indicated at 10. The mounting assembly includes a guide assembly 12 which includes a housing 14 for protection and for cleanliness which extends the life of a vehicle assembly 16 (FIG. 3).

Housing 14 is in the form of a part-cylindrical section, extruded to provide a tube 18. Guide elements 24 are provided inside the tube 18, and are in the form of spaced apart tracks 26 and 28, having an intermediate gap 30 therebetween.

Lateral retaining means 32 are provided in the form of an upstanding flange 36, extending from guide elements 26 and 28. The flange 36 maintains the sliding or rolling direction of the vehicle assembly in a longitudinal direction.

Fastening elements are provided in, housing 14, in the form of a threaded groove 40 which threadably receives a threaded fastener 42 so as to mount end stopper 44 or end support block 46. Access to fastener 42 is provided through intermediate gap 30.

Other fastening means may be provided by access apertures 48 and 49 so that fastener 43 may access and fasten housing 14 to spacer and clamping blocks 50 and 52 respectively.

Arcuate cover plate 54 is provided in order to cover access aperture 48 to provide dust protection, other environmental protection and added strength. Cover plate 54 attaches to housing 14 by enlarged head and tail sections 56 and 58 respectively, which engage with corresponding flanges 57 and 59 respectively. In order to inhibit travel of vehicle assembly 16 past a selected longitudinal point in housing 14, stopper 60 is provided which is in the form of a block 62 having apertures therethrough for receiving fastener 42 which engages with threaded groove 40.

End mounting assembly 64 is provided to support end mounting onto glass or other wall panel 65, the assembly including end mounting block 46 mounted to housing 14 via fastener 42 passing through tab 66 and into threaded groove 40. Fastener 41 passes through aperture 47 in end mounting block 46 and wall aperture 67 to be threadably received into clamping block 68 in a similar arrangement to the side clamping arrangement of: fastener 43; arcuate spacer block 50; and threaded clamping block 52.

The spacer block 50 is provided to space housing 14 from a parallel glass wall 11 so as to provide cleaning of housing 14 and glass wall 11 between housing and wall.

The vehicle assembly 16 includes friction reducing elements 17 mounted on a carriage 19, the friction reducing elements being in the form of two pairs of track engaging wheels 21.

A connector assembly 23 is provided in order to suspend glass door panel 25. The connector assembly 23 includes clamp assembly 27 which includes clamping blocks 29 and 31 which are clamped via fastener 33 passing through clamping block 31, aperture in glass panel 25 (not shown) and threadably fastening into clamping block 29. Connector element 35 maintains clamping blocks 27 and 29 below housing 14.

A pair of vehicle assemblies 16 are provided for each glass panel 25.

In operation the housing 14 provides extended life and an extended smooth running of carriage assembly 16 along tracks 26 and 28 by keeping dust, grime and other adverse environmental effects clear of the wheel track interface. The housing, when assembled, is spaced from adjacent parallel glass walls 11, by arcuate spacer 50 to provide cleaning access there between. An aesthetically pleasing finishes also provided thereby.

It is contemplated that the guide assembly 12 includes a structural member or is inherently structurally rigid enough so as to span a distance between two end walls 65 and (not shown, but parallel to and spaced from 65, or to mount one end wall 65 adjacent to and perpendicular to one parallel wall 11). This would then mean that no other mounting means or means of support or other frames would be required, which reduces visual clutter.

Finally, it is to be understood that the inventive concept in any of its embodiments are capable of being incorporated in many different constructions so that the generality of the preceding description is not to be superseded by the particularity of the attached drawings. Various alterations, modification and/or additions may be incorporated into the various constructions and arrangements of parts without departing from the spirit or ambit of the subject application.

The foregoing description of a preferred embodiment of the subject application has been presented for purposes of illustration and description. It is not intended to be exhaustive or to limit the subject application to the precise form disclosed. Obvious modifications or variations are possible in light of the above teachings. The embodiment was chosen and described to provide the best illustration of the principles of the subject application and its practical application to thereby enable one of ordinary skill in the art to use the subject application in various embodiments and with various modifications as are suited to the particular use contemplated. All such modifications and variations are within the scope of the subject application as determined by the appended claims when interpreted in accordance with the breadth to which they are fairly, legally and equitably entitled.

Having thus described the preferred embodiments, what is claimed is:

1. A mounting assembly adapted for mounting a sliding door to an adjacent associated parallel wall panel transversely located between a pair of opposed associated walls, the mounting assembly comprising:

an elongate guide assembly having a housing and including an end mounting device at least one end thereof which is adapted to attach an end of said elongate guide assembly to one of said opposed associated walls;

a carriage assembly received within said housing and able to undergo reciprocating travel along a lengthwise direction therein, said carriage assembly adapted to support said sliding door; and, at least one side mounting device located on a side of the housing, adapted to attach said elongate guide assembly to said associated parallel wall panel, each side mounting device including a first clamping block, a second clamping block and a fastener, whereby, in use, the first and second clamping blocks are coupled together by said fastener such that the first clamping block is located between the second clamping block and the side of the elongate guide assembly, the fastener being provided through an aperture in said housing to interconnect the first and second clamping blocks with the elongate guide assembly such that the carriage is free to pass through the elongate guide assembly.

2. The mounting assembly of claim 1, wherein the end mounting device includes an inner clamping block located adjacent the end of the elongate guide assembly.

3. The mounting assembly of claim 2, wherein the end mounting device further includes an outer clamping block which is coupled to the inner clamping block by a second fastener.

4. The mounting assembly of claim 2, wherein the inner clamping block includes an offset tab which projects from a surface of the inner clamping block towards the elongate guide assembly.

5. The mounting assembly of claim 4, wherein the elongate guide assembly includes a threaded groove extending in a lengthwise direction along the elongate guide assembly, and wherein the offset tab of the inner clamping block includes an aperture through which a third fastener is passed and engaged with the threaded groove to couple the inner clamping block to the elongate guide assembly.

6. The mounting assembly of claim 1, wherein the first clamping block spaces the side of the housing from said parallel wall panel.

7. The mounting assembly of claim 6, wherein the first clamping block comprises a shaped face, the shaped face having a concave arc contoured to mate in use with the side of the housing.

8. The mounting assembly of claim 7, wherein the first clamping block is formed integrally with the housing.

9. The mounting assembly of claim 1, wherein a stopper is provided internally of the elongate guide assembly which inhibits the passage of the carriage assembly past a selected position along the elongate guide assembly.

10. The mounting assembly of claim 1, wherein the fastener includes a threaded neck dimensioned to pass though the inner aperture and a head which in use abuts an inside wall of the housing adjacent the inner aperture.

11. A mounting assembly for mounting a glass door panel relative to an adjacent associated parallel wall panel, the mounting assembly comprising:

an elongate guide assembly receiving a carriage assembly supporting the glass door panel, the guide assembly allowing reciprocating travel of the carriage assembly in a lengthwise direction within the guide assembly; and, a side mounting device for connecting the guide assembly with the associated parallel wall panel, wherein the side mounting device includes a first clamping block disposed on a side of the associated parallel wall panel adjacent to the elongate guide assembly, and a second clamping block disposed on an opposite side of the associated parallel wall panel, wherein the first and second clamping blocks are adapted to be coupled together with a fastener so as to clamp the associated parallel wall panel therebetween and thereby provide a frameless connection of the elongate guide assembly with the associated parallel wall panel;

wherein the elongate guide assembly further includes a housing having an inner aperture dimensioned to receive the fastener which is mounted through the inner aperture and serves to interconnect the first and second clamping blocks with the elongate guide assembly whereby the fastener is concealed from view within the housing while the carriage is free to pass through the elongate guide assembly; and, wherein the mounting assembly further includes an end mounting device which mounts an end of the elongate guide assembly with an associated perpendicular wall.

12. The door mounting assembly of claim 11, wherein the end mounting device further includes an inner end support block which is in use disposed on a first side of the perpendicular wall immediately adjacent the end of the elongate guide assembly, and an outer end support block which is in use disposed on an opposite side of the perpendicular wall, and wherein the inner and outer end support blocks are coupled together through the perpendicular wall, clamping the perpendicular wall therebetween so as to provide a further frameless connection between the perpendicular wall structure and an end of the elongate guide assembly.

13. The mounting assembly of claim 12, wherein the inner and outer end support blocks are coupled by a second fastener which in use passes through the perpendicular wall.

14. The mounting assembly of claim 11, wherein the end support includes an inner end support block coupled to the end of the elongate guide assembly.

15. The mounting assembly of claim 14, wherein the inner end support block is coupled to the elongate guide assembly by a third fastener that passes through a tab extending from the inner end support block and into an internally longitudinally arranged groove within the elongate guide assembly.

16. The mounting assembly of claim 11, wherein in use the first clamping block spaces the elongate guide assembly a selected distance from the parallel wall panel.

17. The mounting assembly of claim 11, wherein the parallel wall panel is a glass panel.

18. The mounting assembly of claim 17, wherein the perpendicular wall is a glass panel.

19. A mounting assembly for mounting an associated door panel relative to an associated support structure, the mounting assembly comprising:

a carriage assembly including a clamp assembly configured for attachment with the associated door panel;

an elongate guide assembly including a cylindrical housing defining an aperture on a side of the cylindrical housing and an elongate track within the cylindrical housing, the elongate track being configured to slidingly support the carriage assembly allowing reciprocating travel of the carriage assembly relative to the guide assembly;

a side mounting device configured to connect the guide assembly with an associated parallel wall panel of the associated support structure, the side mounting device including first and second clamping blocks and a fastener, the first clamping block being disposed on a side of the associated parallel wall panel adjacent to the elongate guide assembly, the second clamping block being disposed on a side of the associated parallel wall panel opposite from the first clamping block, and the fastener being configured to extend through the aperture in the side of the cylindrical housing and to mutually couple the first and second clamping blocks together so as to clamp the associated parallel wall panel therebetween thereby providing a frameless connection of the elongate guide assembly with the associated parallel wall panel, whereby the fastener is concealed from view within the housing while the carriage is free to pass through the elongate guide assembly; and, an end mounting device configured to connect the guide assembly with an associated perpendicular wall structure of the associated support structure.

* * * * *